United States Patent [19]

Araoka

[11] 4,191,612

[45] Mar. 4, 1980

[54] DEWATERING SUCTION APPARATUS FOR PAPER MAKING MACHINE

[76] Inventor: Ikuo Araoka, 317 Iriyamase, Fuji-shi, Shizuoka, Japan

[21] Appl. No.: 922,166

[22] Filed: Jul. 5, 1978

[51] Int. Cl.[2] ..... D21F 1/52

[52] U.S. Cl. ..... 162/352; 162/257; 162/364; 162/366

[58] Field of Search ..... 162/351, 352, 364, 366, 162/257

[56] References Cited

U.S. PATENT DOCUMENTS 1,279,170 9/1918 Sullivan ..... 162/366

3,463,700 8/1969 Brewster et al. ..... 162/351 X

*Primary Examiner*—Richard V. Fisher

*Attorney, Agent, or Firm*—Wenderoth, Lind & Ponack

[57] ABSTRACT

A dewatering suction apparatus for paper making machine having foil plates which form suction slots under a wet paper conveyor belt has an air outlet nozzle which injects air under the conveyor belt on the upstream side of the suction slots generally counter to the direction of movement of the belt. The apparatus also has an auxiliary suction device on both side edges of the belt. The auxiliary suction device has a side edge sensing finger to control the size of the suction slot opening at each side edge of the belt.

2 Claims, 8 Drawing Figures

DEWATERING SUCTION APPARATUS FOR PAPER MAKING MACHINE

BACKGROUND OF THE INVENTION

The present invention relates to an improved dewatering suction apparatus for a paper making machine.

Conventional dewatering suction apparatus has a plurality of suction boxes engaging the lower surface of a wet paper conveyor belt which is made of felt or wire mesh. Each suction box is generally a rectangular box having slots, perforations or foil plates at the upper surface which engages the conveyor belt. The suction box is connected through a water separator tank with a vacuum pump which induces negative pressure in the suction box to suck water from the wet paper on the conveyor belt. The vacuum pump for each suction box comsumes considerable power and thus increases the operating cost. Further, early wear of the conveyor belt and noise of the vacuum pumps are also disadvantages of the conventional suction apparatus.

SUMMARY OF THE INVENTION

A dewatering suction apparatus according to the present invention has air outlet nozzle means which is arranged at the upstream end of the suction box and directs air, preferably warm air, against the lower surface of the wet paper conveyor belt generally counter to the direction of movement of the conveyor belt. Thus negative pressure at the adjacent suction box is reinforced which increases the suction capacity of the suction box.

Further, auxiliary suction means are mounted at both side edges of the suction box. The suction slot of each auxiliary suction means extends beyond each side edge of the conveyor belt so as to be beneath the edge of the belt even when there is lateral movement of the conveyor belt. A sensor finger means follows the position of the side edge of the conveyor belt and moves valve means which limits the size of the suction slot opening to correspond to the position of the side edge of the conveyor belt. Thus, the entire width of the conveyor belt is effectivly dewatered.

Suction pipes connected with each suction box and the auxiliary suction means are all connected through one water separator tank with the suction side of one blower, and the outlet side of the blower is connected with the air nozzle means. Only one blower is used in place of three or four vacuum pumps, so that power consumption is greatly decreased and the dewatering suction system is simplified. Further, by negative pressure induced by the air nozzle means, the dewatering capacity is increased without strong contact between the conveyor belt and the suction box, so that the early wear problem of the conveyor belt is also mitigated.

The general object of the present invention is to provide a dewatering suction apparatus for a paper making machine having means to effectively dewater wet paper on a conveyor belt.

The other object of the present invention is to provide a dewatering suction apparatus which dewaters the entire width of the conveyor belt.

Another object of the present invention is to provide a dewatering suction apparatus which utilizes a single blower in place of vacuum pumps.

A further object of the present invention is to provide a dewatering suction apparatus which has a simple construction and low operating cost.

The objects and advantages of the present invention will be apparent from the following description of embodiments, by way of example, and the accompanying drawings.

DETAILED DESCRIPTION OF PREFERRED EMBODIMENT

Figure 1:
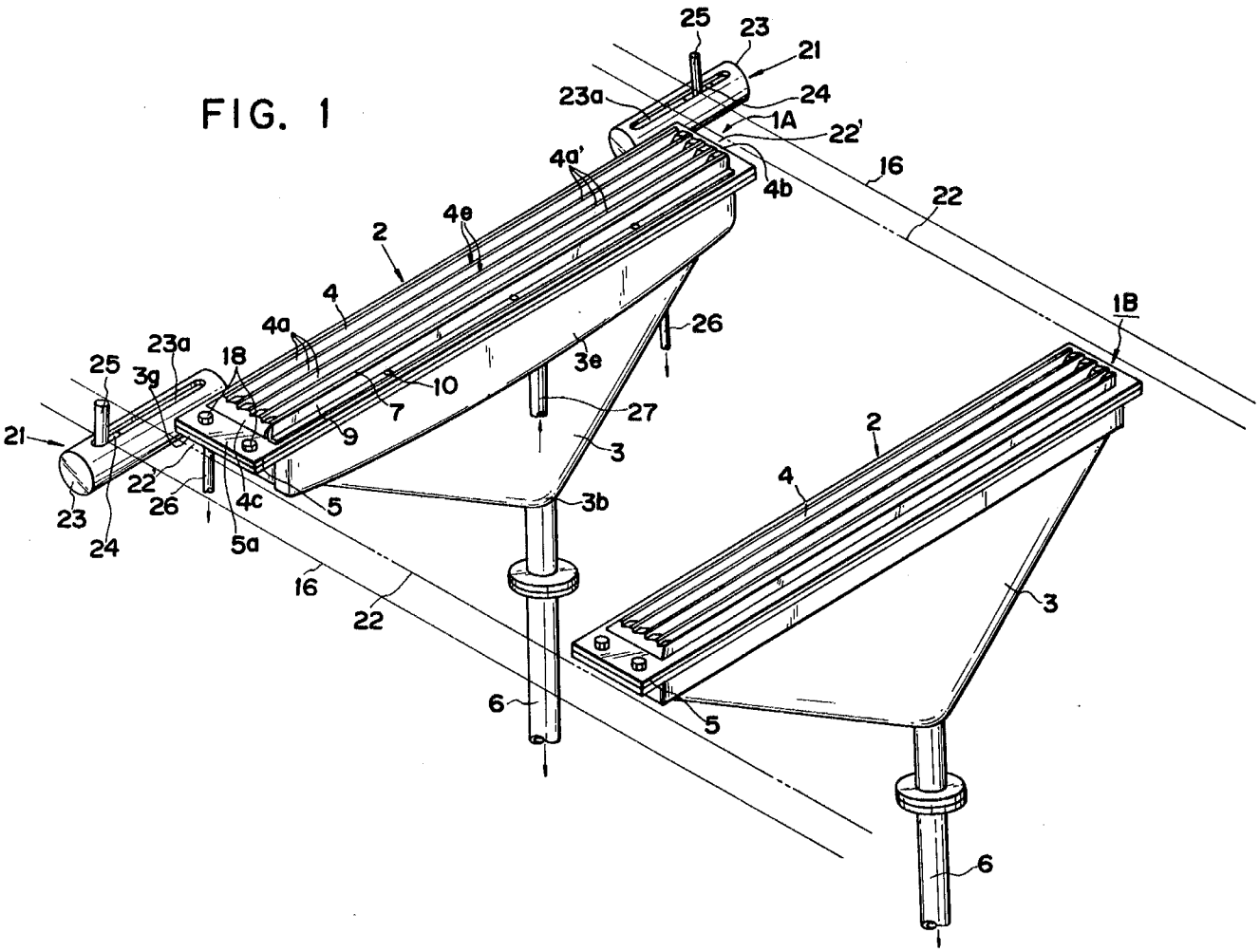
FIG. 1 is a perspective view of suction box assemblies of a dewatering suction apparatus according to the present invention.
Figure 2:
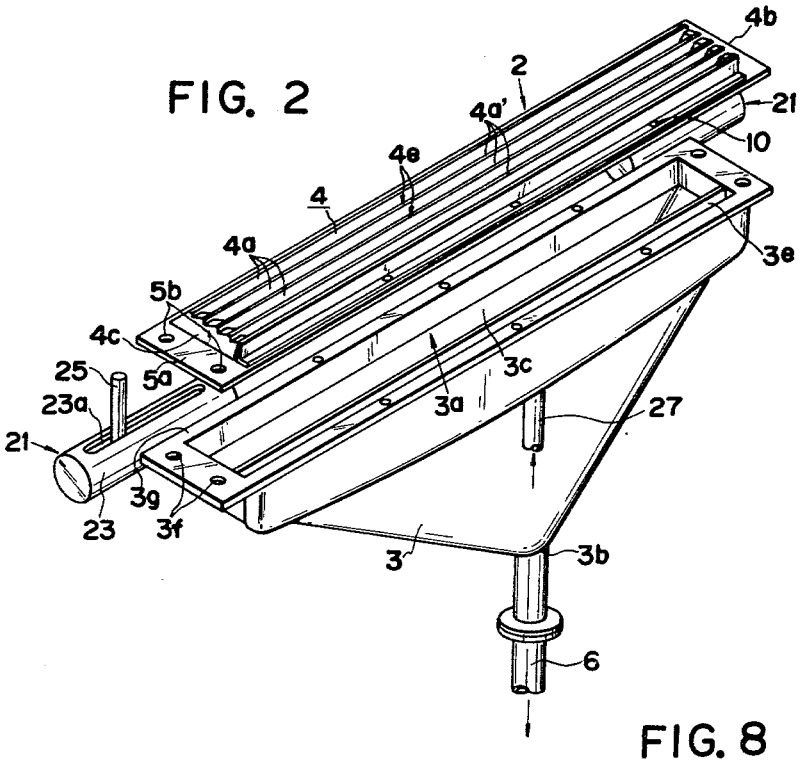
FIG. 2 is an exploded perspective view of one of the suction box assemblies shown in FIG. 1.
Figure 6:
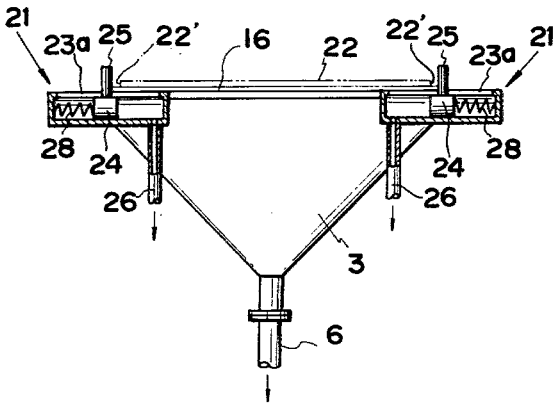
FIG. 6 is a longitudinal sectional view of auxiliary suction means shown in FIG. 1.

Referring to FIGS. 1 and 2, the dewatering suction apparatus according to the present invention comprises a suction box assembly 1A which includes a foil plate assembly 2 and a box assembly 3. The foil plate assembly 2 has a hydrofoil group 4 shown in FIGS. 2 and 5. The hydrofoil group 4 consists of a series of foils 4*a* which have ridges *ra'* facing upstream of a paper conveyor belt 16 shown in FIG. 7. Both ends of the foil 4*a* are connected by side walls 4*b* and 4*c*. The foils 4*a* and the side walls 4*b* and 4*c* define between them a series of suction slots 4*e* extending through a base plate 5 of the foil plate assembly 2.

The base plate 5 is generally rectangular and has a peripheral mounting flange 5*a* which has a plurality of mounting holes 5*b*. The hydrofoil group 4 projects from the base plate 5 upwards, and extends longitudinally on the base plate 5. The base plate 5 and the hydrofoil group 4 are molded integrally from a suitable plastic to form the foil plate assembly 2. The lengths of the base plate and the hydrofoil group 4 are according to the width of the paper which is to be covered by the suction slots 4*e* of the hydrofoil group 4.

Figure 5:
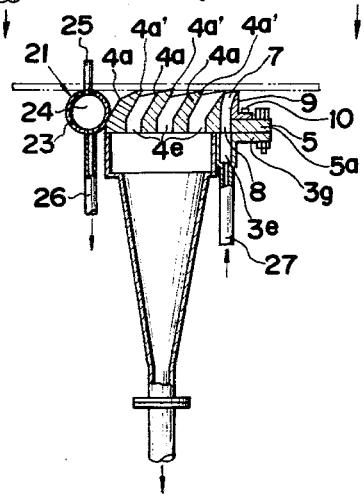
FIG. 5 is a transverse sectional view of the suction box shown in FIGS. 1 and 2.

The foil plate assembly has an air outlet nozzle device 7 which is parallel with the suction slot 4*e*. The outlet air supplied thereto may be warm air, hot air or steam. The foil plate assembly 2 has an air outlet slot 8 which is parallel with the upstream suction slot 4*e* as shown in FIG. 5. A blade 9 is provided along the upstream side of air outlet slot 8. Between the blade 9 and the upstream foil 4*a* is defined the air outlet slot 8. The blade 9 may be secured to the base plate 5 by screws 10.

The box assembly 3 has a generally rectangular opening 3*a* which is covered by the foil plate assembly 2. Around the opening 3*a* is a mounting flange 3*g* which has mounting holes 3*f* corresponding with the mounting holes 5*b* of the foil plate 2. When the mounting flange 5*a* of the foil plate 2 is placed on the mounting flange 3*g* of the box assembly 3, the mounting holes 5*b* and 3*f* are aligned, and bolts 18 are secured therein so that the opening 3*a* of the box assembly 3 is covered by the foil plate assembly 2.

Figure 3:
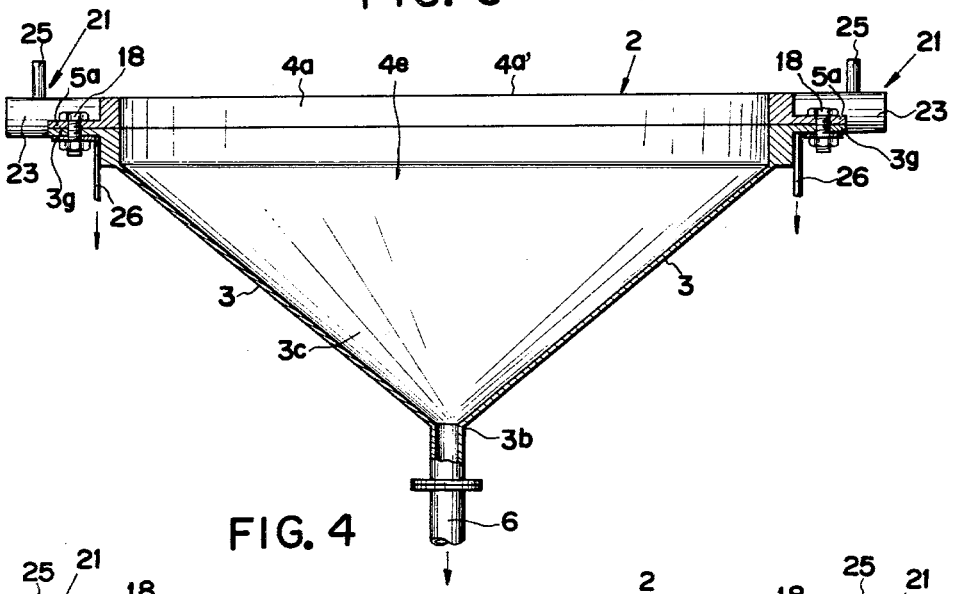
FIG. 3 is a longitudinal sectional view of the suction box shown in FIGS. 1 and 2.
Figure 7:
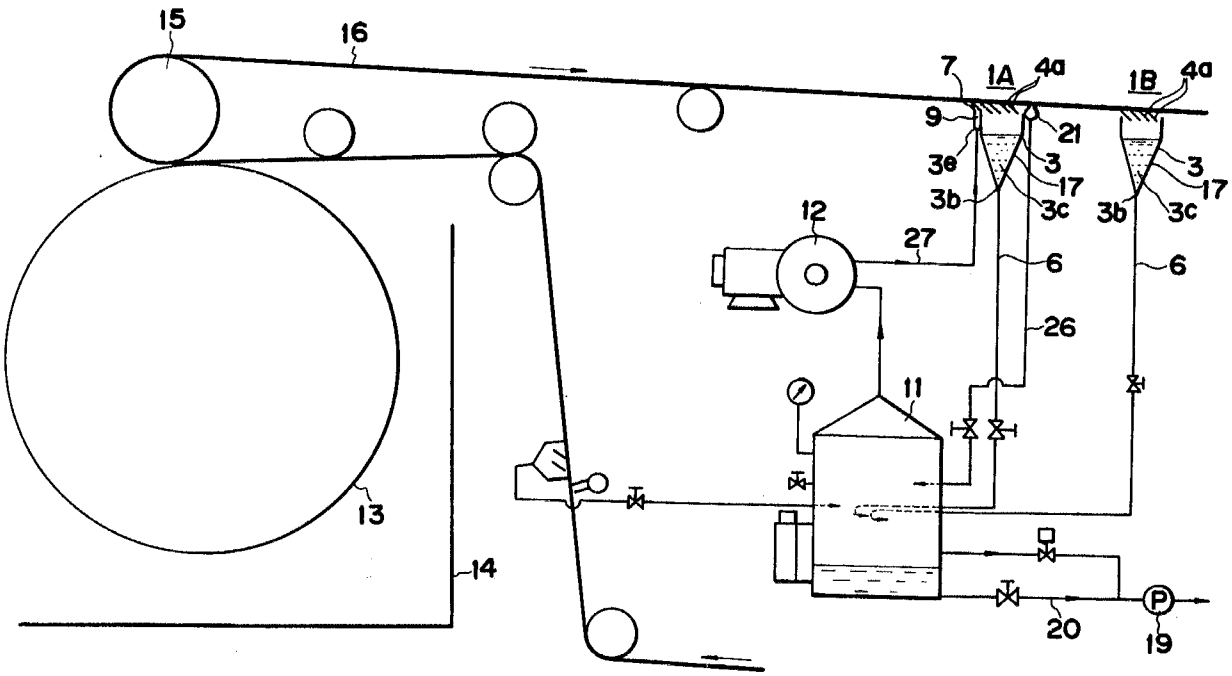
FIG. 7 is a diagram of the dewatering suction apparatus according to the present invention.

As shown in FIGS. 3 and 5, side plates of the box 3 taper from the opening 3*a* to form a generally inverted pyramid and define a suction chamber 3*c*. The apex of the inverted pyramid has a small opening 3*b* which is connected with a small diameter suction pipe 6. The suction pipe 6 extends vertically from the opening 3*b* and sufficient suction is exerted therethrough to produce the required water head in the suction chamber. The pipe 6 extends into a water separator tank 11. As shown in FIG. 7, a water drain pipe 20 is connected between the bottom of the tank 11 and a drain pump 19.

Figure 4:
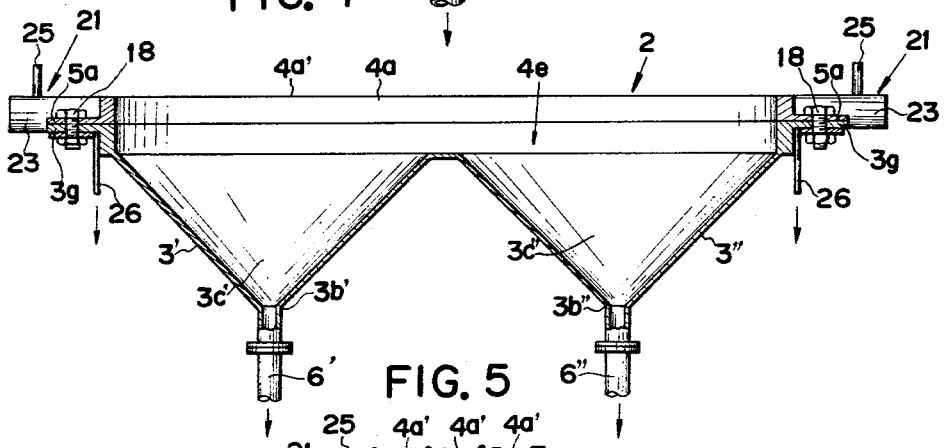
FIG. 4 is a longitudinal sectional view of a suction box according to another embodiment.

As shown in FIG. 4, the box 3 may be formed as a series of inverted pyramids 3′ and 3″ in the width direction of the paper conveying belt. The apex of each inverted pyramid has a small opening 3*b*′ or 3*b*″ which is connected with a small diameter suction pipe 6′ or 6″ which in turn is communicated with the water separator tank 11.

As shown in FIG. 7, the suction inlet of a blower 12 is connected with the top portion of the separator tank 11. Thus, the suction pipe 6 is connected with the suction inlet of the blower 12 through the separator tank 11 to produce a suction head at the suction slots 4*e*.

The box assembly 3 also includes an introducing chamber 3*e* adjacent the suction chamber 3*c*. The air introducing chamber 3*e* is covered by the foil plate 2 which is mounted on the opening 3*a* of the box 3. The air introducing chamber 3*e* is communicated with the air outlet slot 8 of the foil plate 2.

The outlet air from the blower 12 is supplied through an air supply pipe 27 and the air introducing chamber 3*e* to the air outlet slot 8. Thus, one blower 12 is utilized for producing suction in the suction pipe 6 and for an air supply means for supplying air to the air outlet slot 8 of the suction box assembly 1A.

The dewatering suction apparatus according to the present invention includes auxiliary suction means 21. The auxiliary suction means 21 acts to dewater both side edge portions of the wet paper 22 on upper surface of the wet paper conveyor belt 16. As shown in FIG. 1, the auxiliary suction means 21 is mounted on the downstream side surface of the suction box assembly 2, i.e. on the opposite side from the air outlet slot 8.

The auxiliary suction means 21 comprises a hollow cylindrical member 23 on each end of the suction box 3 and having a suction chamber therein. Along the upper surface of the cylindrical member 23 is provided a longitudinal suction slot 23*a*. The suction slot 23*a* opens toward the under surface of the side edge of the wet paper conveyor belt 16 and extends beyond the side edge of the conveyor belt 16. In the cylindrical member 23 is slidably mounted a cylindrical valve 24 which is urged inwardly of the belt by a spring 28. The valve 24 has a sensing finger 25 which projects upwardly through the suction slot 23*a* and the respective fingers 25 contact the opposite side edge surfaces of the conveyor belt 16. The sensing fingers 25 sense lateral movement of the wet paper conveyor belt 16 and follow the side edges of the belt 16 due to the force of the spring 28 and move the valves 24 along the suction slots 23*a* to prevent the slots from being open to the space beyond the side edges of the belt 16. The width of the wet paper 22 is not always constant and frequently projects beyond the suction slots 4*e* of the suction box assembly 2 when it is too wide or because of lateral movement of the belt 16. When the lateral edges 22′ of the wet paper project beyond the suction slots 4*e* no suction is applied and the paper contains too much water.

The auxiliary suction means 21 effectively dewaters the lateral edge portions of the conveyor belt 16 by maintaining effective suction slots 23*a* under the conveyor belt 16 by the sensing fingers 25 which move the valves 24 along the slots 23*a* to close the portions of the slots 23*a* which extend beyond the side edges of the conveyor belt 16.

The lateral edge position signals from the sensing fingers 25 may be used to control the lateral position of the conveyor belt 16. When the conveyor belt 16 moves laterally beyond a predetermined limit, a control apparatus applies a signal to move the axis of an end sprocket for the belt in a horizontal plane to correct the course of the conveyor belt. The sensing fingers 25 may close a limit switch not shown to actuate the control apparatus.

Figure 8:
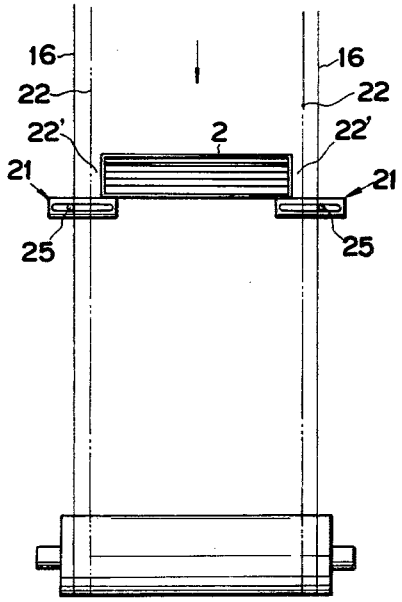
FIG. 8 is a partial plan view of a wet paper conveyor belt shown in FIG. 7.

In a known paper making process, when the conveyor belt run is pressed at the end of the belt as shown in FIG. 8, the side edge portions of the paper tend to cut or separate because too much water is squeezed from both edges of the belt. By the provisions of the auxiliary suction means 21 according to the invention, the side edge portions are also uniformly dewatered.

A suction pipe is connected with the suction chamber of each cylinderical member 23. The other end of the suction pipe 26 is connected with each water separator tank 11 as shown in FIG. 7, or with a portion of the suction pipe 6 of the suction box assembly 2 if desired. As described above, since the tank 11 is connected with the suction side of the blower 12, the suction head of the blower 12 is applied through the suction pipe 26 to the suction chamber of the auxiliary suction means 21.

FIG. 7 shows diagrammatically the dewatering system of a cylinder paper making machine utilizing a dewatering suction apparatus according to the present invention. A vat 14 receives paper pulp which is supplied on a cylinder 13 to form wet paper. The wet paper is transferred on the conveyor belt 16 by a couch roll 15.

As shown in FIG. 7, the dewatering suction system according to a preferred embodiment of the present invention includes a suction box assembly 1A having an air outlet nozzle device 7 on the upstream side and a suction box assembly 1B without an air outlet nozzle device on the downstream side, and both being positioned under the conveyor belt 16 to dewater wet paper on the conveyor belt. The suction box assembly 1A also has auxiliary suction means 21 at both sides to dewater the side edge portions of the conveyor belt 16.

Suction pipes 6 and 26 connected with the suction box 3 and the cylindrical members 23 extend vertically downwards and are connected with the common water separator tank 11. The top portion of the separator tank 11 is connected with suction side of the blower 12 to extract air from the tank 11. The outlet side of the blower 12 is connected with the air outlet slot 8 of the suction box assembly 1A. The air from the blower 12 has a relatively high temperature and is discharged from the outlet slot 8 of the foil plate assembly 2 under the conveyor belt 16 counter to the direction of movement of the belt. The counterflow injection of warm air causes negative pressure at adjacent downstream portions of the lower surface of the belt 16 and the upper surface of the foil plate assembly to produce a large suction force in the suction slots 4*e* and 23*a*. The suction force of the blower 12 is relatively weak compared with that of a conventional vacuum pump. However, the combined effect of the suction and injection of air by the blower 12 is more efficient. Also, warm air injection from the nozzle device 7 causes expansion of ambient air to increase the negative pressure in the adjacent suction slots. By the extraction of air from the separator tank 11, water proportional to the air volume is sucked from the suction pipes 6 and 26. Thus strong dewatering suction is obtained by the blower 12 even though it has a relatively weak suction force.

In operation, as shown in FIG. 7, a water level 17 is maintained in the inverted pyramid suction chamber 3*c* of the suction box 3, and water is sucked vertically downward from the apex of the pyramid through the vertical pipe 6, to maintain a sufficient water head.

Thus, sufficient negative pressure caused by the water head is maintained in the suction box. The vacuum is greater the greater the water head. The only function of the blower 12 is to extract air from the water separator tank 11. Thus, the power of the blower 12 can be very low.

In a conventional Fourdrinier paper making machine for making paper with a width of 2000 mm and at a speed of 200 m/min, and a conventional cylinder paper making machine for making paper with a width of 1800 mm and at a speed 270 m/min, both machines have four suction pumps of 22 KW, 15 KW, 11 KW and 7.5 KW, and one water separator tank for each suction pump. In the present suction apparatus only one blower of 5.5 KW and one separator tank are sufficient to obtain a comparable dewatering capacity. Thus, as compared with the powerful suction pumps and heavy motors of a conventional suction apparatus, the combined effect of the water head and only one blower of low power of the suction apparatus according to the present invention provides sufficient dewatering capacity.

Further as shown in FIG. 7, only one water separator tank 11 and one blower 12 are sufficient for a plurality of suction boxes and auxiliary suction means to provide sufficient dewatering capacity.

It will be appreciated that the suction apparatus according to the present invention greatly simplifies the paper making equipment and eliminates the noise problem of conventional suction pumps.

What is claimed is:

1. A paper making machine including a dewatering suction apparatus having at least one suction box assembly which has opening means closed by the under surface of a wet paper conveyor belt, said suction box assembly comprising:

a plurality of foil plates extending parallel to the widthwise direction of said conveyor belt and defining a plurality of suction slots at said opening means;

an air outlet nozzle means extending parallel with said foil plates at the upstream side of the foil plates; and auxiliary suction means at both side edge portions of said conveyor belt, each auxiliary suction means comprising:

means defining a suction inlet opening extending beyond said side edge of said conveyor belt;

valve means movable along said suction inlet opening to limit the effective suction dimension of said suction inlet opening; and sensing finger means secured to said valve means and sensing corresponding side edges of the conveyor belt by following said side edges to control the position of the valve means.

2. A paper making machine as claimed in claim 1, in which said suction box assembly and said auxiliary suction means are connected through a water separator tank with the suction side of a blower, and the outlet side of said blower is connected with the inlet of said outlet nozzle means.

* * * * *